US005292264A

United States Patent [19]

Blank

[11] Patent Number: 5,292,264

[45] Date of Patent: Mar. 8, 1994

[54] EARTHING STUD

[75] Inventor: Ekhard Blank, Wolfsburg, Fed. Rep. of Germany

[73] Assignee: Emhart Inc., Newark, Del.

[21] Appl. No.: 945,189

[22] Filed: Sep. 15, 1992

[30] Foreign Application Priority Data

Sep. 17, 1991 [DE] Fed. Rep. of Germany ... 9111564[U]

[51] Int. Cl.[5] ..... H01R 4/30

[52] U.S. Cl. ..... 439/813; 439/809

[58] Field of Search ..... 439/809, 813, 801

[56] References Cited

U.S. PATENT DOCUMENTS 4,049,335 9/1977 Julian et al. .

4,410,226 10/1983 Adduci et al. ..... 439/801

FOREIGN PATENT DOCUMENTS 487365 5/1992 European Pat. Off. .

8425599 8/1984 Fed. Rep. of Germany .

611554 10/1926 France ..... 439/809

872877 6/1942 France .

8548 5/1905 United Kingdom ..... 439/809

*Primary Examiner*—Gary F. Paumen

*Attorney, Agent, or Firm*—Spencer T. Smith

[57] ABSTRACT

An earthing stud for use as a weld stud for the application of a cable-retaining terminal with cable holder having a base part with non-circular boundary and a cooperating plastic part having a lower portion with an internal boundary matching the external boundary of the base part and an upper portion provided with recesses for receiving the cable holder.

4 Claims, 2 Drawing Sheets

EARTHING STUD

BACKGROUND OF THE INVENTION

The present invention relates to an earthing stud designed as a weld stud for the application of a cable terminal with cable holder.

Known weld studs have a shank and a flange adjacent thereto, the flange having, on its side remote from the shank, a weld face which serves for welding the weld stud onto a metallic article or a metal plate. Such weld studs are used, for example, in the production of motor vehicles for fastening brake tubes, fuel lines and electric leads. If electric leads are to be fastened, the shank preferably has an external thread, the lead is arranged via a cable holder on a cable terminal, and the cable terminal is fastened on the shank by means of a nut.

A problem which repeatedly poses problems in the fastening of components on weld studs resides in the fact that the components are generally inadequately protected from twisting. Forces and torques of greatly different natures and values act upon the components held by the weld studs owing to the vibrations originating during movement of the vehicle body. As already described in German Gebrauchsmuster application G 84 25 599.4, these torques can lead to twisting of the component relative to the weld stud. The component is therefore loosened, particularly if the shank has spiral projections, i.e. a thread, so that the component can no longer fulfil its function to an optimum. According to the above-mentioned Gebrauchsmuster application, a non-rotatable connection between component and weld stud and a reliable, correctly positioned assembly is achieved in that the shank is divided into two immediately adjacent regions, the first region being provided with substantially radially encircling projections for absorbing an axial force and the second region having several beads for absorbing a torque, these beads being parallel to the axis, being distributed round the periphery, having an external diameter which is greater than the corresponding internal diameter of the bore of the component and pressing themselves in the bore of the component.

If the component to be fastened, for example a cable terminal, has an extremely small height, this specified solution to the problem is unsuitable. The second region, provided on the flange of the weld stud, with beads, parallel to the axis, should have an equally small height as the component to guarantee that axial displacement cannot occur. However, this is accompanied by problems in production and has the further disadvantage that weld studs of different designs would have to be provided for each different height of different cable terminals. Furthermore, cable terminals are normally produced from a material which is not very strong so the cable terminal could be destroyed when applied to a weld stud provided with axial beads.

In the case of weld studs with a shank having only a thread and no axially parallel beads, the cable terminal is applied to the weld stud by tightening a nut arranged over the cable terminal. It may happen that the cable terminal is also rotated in a disadvantageous manner. Moreover, it can happen with an earthing stud according to the prior art that the cable terminal twists when the tightened nut is loosened in the course of time, owing to wear, which, in extreme cases, could go so far that the cable terminal or a connected cable of which the protective sheath is destroyed produces a short circuit owing to contact with another cable or component. Even though a plastic cap is generally placed over an earthing stud according to the prior art, the aforementioned problem cannot be ignored; the problem of twisting of the cable terminal during fitting of the cable terminal cannot be solved by providing a plastic cap.

It is accordingly the object of the invention to develop an earthing stud designed as a weld stud for the application of a cable terminal with cable holder such that twisting of the cable terminal is inhibited.

BRIEF DESCRIPTION OF THE INVENTION

According to the present invention, an earthing stud for use as a weld stud, for the application of a cable terminal with cable holder has a base part with a non-circular external boundary and is provided with a cooperating plastic part of which the lower portion has an internal boundary matching the external boundary of the base part and of which the upper portion has recesses for receiving the cable holder. The non-circular design of the external diameter of the base part of the earthing stud and the corresponding non-circular design of the lower portion of the plastic part allow a secure non-rotatable connection between the earthing stud and the plastic part. The cable holder of the cable terminal, on which a cable is fastened, is guided through the recesses, advantageously ensuring that the cable terminal is fixed in a firm position and cannot twist even during assembly.

Accordingly, the external boundary of the base part of the earthing stud and the internal boundary of the lower portion of the plastic part are preferably hexagonal in design. The lower portion of the plastic part may have a circular external diameter; the thinner-walled upper portion equally may have a circular internal diameter and a circular external diameter which coincides with the external diameter of the lower portion. The recesses are preferably provided in each case at the level of the edges of the internal boundary of the plastic part. The entire arrangement is advantageously designed such that the plastic part has a smaller height than the weld stud. When the plastic part is arranged on the earthing stud, the plastic part is pressed onto the earthing stud in order to produce a press fit between the earthing stud and the plastic part. The plastic part is preferably produced as an injection moulding.

BRIEF DESCRIPTION OF THE DRAWINGS

In order that the invention can be better understood, a preferred embodiment will now be described in greater detail by way of example and with reference to the accompanying drawings in which.

DETAILED DESCRIPTION OF DRAWINGS AND PREFERRED EMBODIMENT

Figure 1:
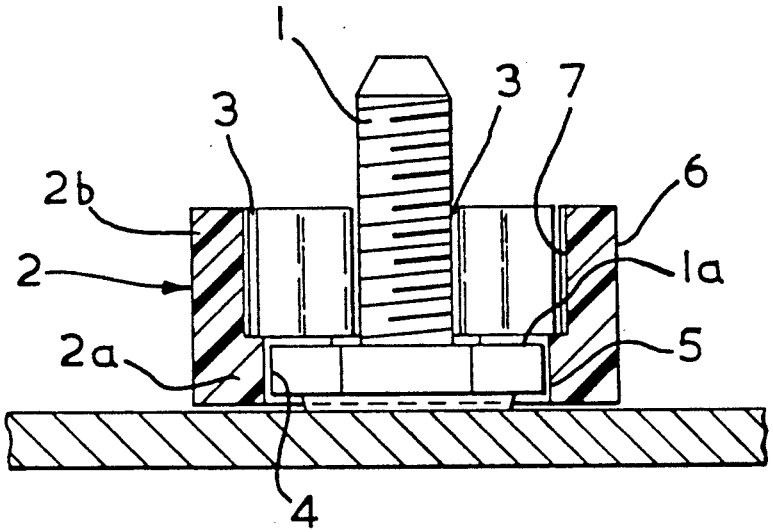
FIG. 1 is a side view of an earthing stud with plastic part according to the invention.

FIG. 1 shows an earthing stud 1, arranged on a metallic article, for the arrangement of a cable terminal 8*a*, the earthing stud 1 being provided with a plastic part 2 having recesses 3 on its upper portion 2*b*. The plastic part 2 also consists of a lower portion 2*a* having a hexagonal internal boundary 5, which surrounds the external boundary of the base part la of the earthing stud 1, and a circular external diameter 6 coinciding with the external diameter 6 of the upper portion 2*b*. The internal boundary of the upper portion 2*b* is a circular internal diameter 7.

The base part la of the earthing stud 1 is also hexagonal in design. The recesses 3 on the plastic part 2 for fixing the cable terminal 8*a* are provided in each case at the level of the edges of the internal boundary 5 of the lower portion 2*a* of the plastic part 2. FIG. 1 shows that the plastic part 2 has a smaller overall height than the earthing stud 1.

Figure 2:
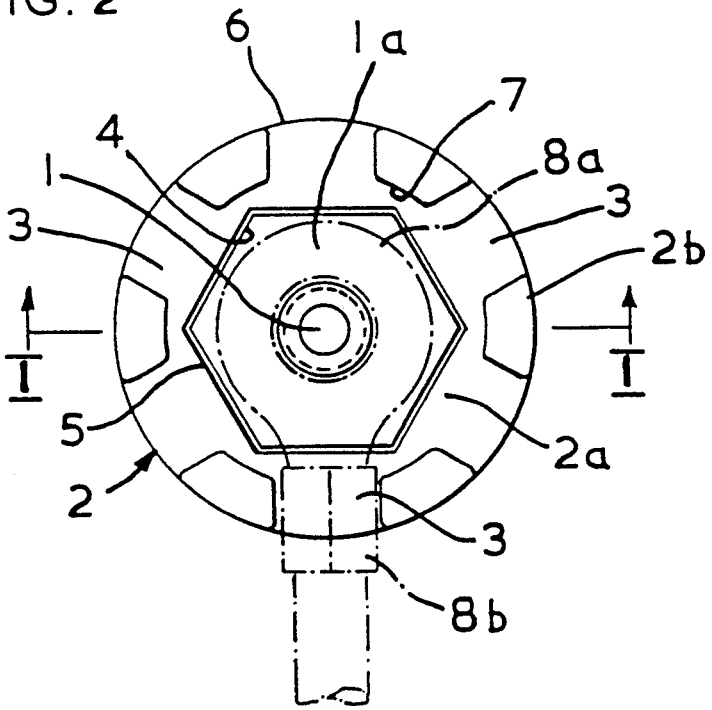
FIG. 2 is a plan view of the earthing stud with plastic part.

FIG. 2 shows a plan view of the earthing stud according to the invention. This figure shows particularly advantageously the hexagonal design of the internal boundary 5 of the lower portion 2*a* of the plastic part 2 and the external boundary 4 of the base part la of the earthing stud. FIG. 2 also shows a cable terminal 8*a* in broken lines, which is fixed in a firm position via a cable holder 8*b* in one of the recesses 3 in the plastic part 2.

Figure 3:
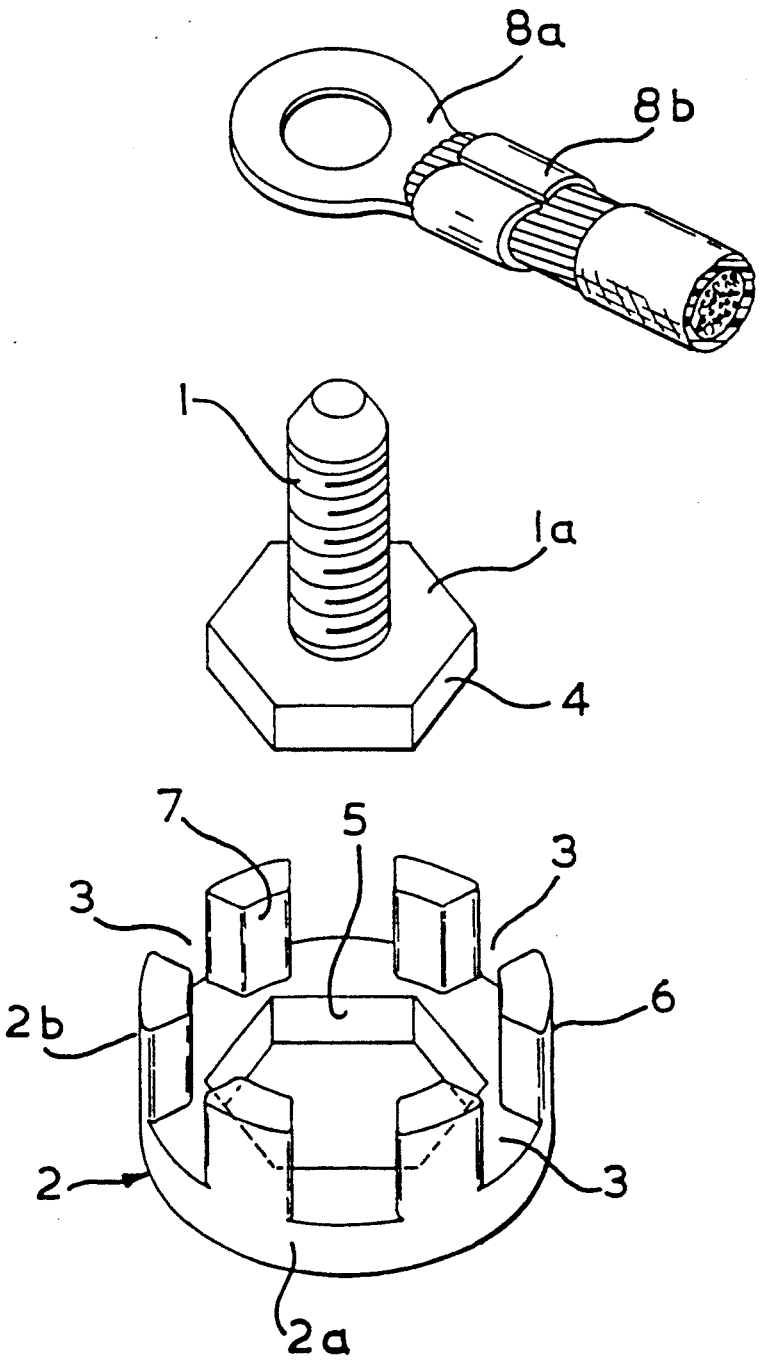
FIG. 3 is an exploded view of the earthing stud with the plastic part and a cable stud.

FIG. 3 is an exploded view showing the plastic part 2, the weld stud 1 and the cable terminal 8*a* in detail. This figure particularly clarifies the design according to the invention of the weld stud 3 with a hexagonal base part 1*a* and of the plastic part 2 of which the lower portion 2*a* has an internal boundary 5 matching the base part 1*a* of the earthing stud 1 and of which the upper portion 2*b* has recesses 3 for receiving the cable holder 8*b* of a cable terminal 8*a*. The cable terminal 8*a* is illustrated above the earthing stud 1. It can be arranged on the earthing stud 1 fixed in a firm position by the plastic part 2.

I claim:

1. An earthing connection mount for use in connecting an earthing cable to an automobile body comprising a stud adapted to be welded to an automobile body part, said stud including a non-circular base and an elongated threaded part;

a plastic part including an end wall having an aperture, said aperture being shaped and sized to be fitted over said base for non-rotatable engagement therewith;

said plastic part including a generally cylindrical portion surrounding said threaded part and spaced therefrom to allow mounting of an electric connector and a nut on said threaded part;

said plastic part further including recesses through said cylindrical portion for receiving at any one of said recesses, a radially extending connection to the earth cable;

the width of said recesses corresponding approximately to the width of the connection extending therethrough to minimize rotation of the connector on said stud.

2. An earthing connection mount according to claim 1, wherein the external boundary of said base is hexagonal.

3. An earthing connection mount according to claim 1, wherein each of said recesses extend downwardly to the level of said end wall.

4. An earthing connection mount according to claim 1, wherein said plastic part has a smaller overall height than said threaded part.

* * * * *